US010790618B2

(12) United States Patent
Munoz et al.

(10) Patent No.: US 10,790,618 B2
(45) Date of Patent: Sep. 29, 2020

(54) ELECTRICAL CONNECTOR SYSTEM HAVING A HEADER CONNECTOR

(71) Applicant: TE CONNECTIVITY CORPORATION, Berwyn, PA (US)

(72) Inventors: Arturo Pachon Munoz, Harrisburg, PA (US); Sean Patrick McCarthy, Palmyra, PA (US); Justin Dennis Pickel, Hummelstown, PA (US); Timothy Robert Minnick, Enola, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/224,494

(22) Filed: Dec. 18, 2018

(65) Prior Publication Data

US 2019/0237911 A1 Aug. 1, 2019

Related U.S. Application Data

(60) Provisional application No. 62/623,935, filed on Jan. 30, 2018.

(51) Int. Cl.
*H01R 13/6587* (2011.01)
*H01R 13/504* (2006.01)
*H01R 12/73* (2011.01)

(52) U.S. Cl.
CPC ..... *H01R 13/6587* (2013.01); *H01R 12/73* (2013.01); *H01R 13/504* (2013.01)

(58) Field of Classification Search
CPC .. H01R 13/6587; H01R 13/73; H01R 13/504; H01R 13/5205; H01R 13/6471
USPC ..... 439/607.07, 607.08
See application file for complete search history.

(56) References Cited

U.S. PATENT DOCUMENTS 8,002,581 B1 * 8/2011 Whiteman, Jr. ..... H01R 12/724 439/607.18
8,579,636 B2 * 11/2013 Davis ..... H01R 12/7082 439/65
8,662,924 B2 * 3/2014 Davis ..... H01R 13/6477 439/607.07
8,905,786 B2 * 12/2014 Davis ..... H01R 13/6587 439/108
8,936,474 B2 * 1/2015 Katsuse ..... H01R 9/223 439/701
9,017,103 B2 * 4/2015 Davis ..... H01R 12/716 439/607.1
9,142,896 B2 * 9/2015 Wickes ..... H01R 9/2408
9,257,778 B2 * 2/2016 Buck ..... H01R 13/516
9,312,643 B2 * 4/2016 Jeon ..... H01R 13/6587
(Continued)

*Primary Examiner* — Peter G Leigh

(57) ABSTRACT

A header connector includes signal contacts, header shields and a header housing holding the signal contacts and the header shields. The signal contacts each have a base, a mating pin and a mounting portion. The header shields have walls defining shield pockets receiving corresponding pairs of the signal contacts to provide electrical shielding for the pairs of signal contacts. Each header shield has a base and a mounting portion. The header housing has a front shell and a rear shell. The front shell is dielectric and the rear shell is conductive and providing electrical shielding for the signal contacts. The front shell holds the signal contacts. The rear shell holds the header shields and is electrically connected to each of the header shields.

25 Claims, 6 Drawing Sheets

(56) References Cited

U.S. PATENT DOCUMENTS

| | | | | |
|---|---|---|---|---|
| 9,356,401 | B1 * | 5/2016 | Horning | H01R 13/6585 |
| 9,401,569 | B2 * | 7/2016 | Davis | H01R 13/6585 |
| 9,407,045 | B2 * | 8/2016 | Horning | H01R 13/6594 |
| 9,559,465 | B2 * | 1/2017 | Phillips | H01R 13/6471 |
| 9,608,382 | B2 * | 3/2017 | McClellan | H01R 13/6587 |
| 9,666,961 | B2 * | 5/2017 | Horning | H01R 12/7076 |
| 9,748,698 | B1 * | 8/2017 | Morgan | H01R 13/6587 |
| 9,831,608 | B1 * | 11/2017 | Pickel | H01R 13/6471 |
| 10,128,616 | B2 | 11/2018 | Morgan et al. | |
| 10,186,811 | B1 | 1/2019 | Trout et al. | |
| 2007/0059961 | A1 * | 3/2007 | Cartier | H01R 13/6474<br>439/191 |
| 2010/0055933 | A1 * | 3/2010 | Laurx | H01R 23/688<br>439/65 |
| 2013/0217263 | A1 * | 8/2013 | Pan | H01R 13/6474<br>439/607.07 |
| 2017/0069986 | A1 * | 3/2017 | Horning | H01R 12/7076 |

* cited by examiner

ELECTRICAL CONNECTOR SYSTEM HAVING A HEADER CONNECTOR

CROSS REFERENCE TO RELATED APPLICATIONS

This application claims benefit to U.S. Provisional Application No. 62/623,935, filed Jan. 30, 2018, titled "ELECTRICAL CONNECTOR SYSTEM HAVING A HEADER CONNECTOR", the subject matter of which is herein incorporated by reference in its entirety.

BACKGROUND OF THE INVENTION

The subject matter herein relates generally to header connectors for electrical connector systems.

Some electrical systems utilize electrical connectors, such as header assemblies and receptacle assemblies, to interconnect two circuit boards, such as a motherboard and daughtercard. Some known electrical connectors include a housing holding signal contacts and ground shields providing electrical shielding for the signal contacts. The signal contacts and the ground shields include mounting portions, such as eye of the needle pins, terminated to the circuit board. The circuit board includes signal vias and ground vias to receive the mounting portions. The mounting interface between the signal contacts and the ground shields with the circuit board is electrically noisy and an area of signal degradation.

A need remains for an electrical connector system providing electrical shielding for the signal contacts for terminating high speed, high density electrical connectors to circuit boards.

BRIEF DESCRIPTION OF THE INVENTION

In one embodiment, a header connector is provided including signal contacts, header shields and a header housing holding the signal contacts and the header shields. The signal contacts are arranged in pairs each having a base, a mating pin extending from a front of the base and a mounting portion extending from a rear of the base for termination to a circuit board. The header shields have walls defining shield pockets receiving corresponding pairs of the signal contacts to provide electrical shielding for the pairs of signal contacts. Each header shield has a base and a mounting portion extending from a rear of the base for termination to the circuit board. The header housing has a front shell and a rear shell. The front shell is dielectric and the rear shell is conductive and providing electrical shielding for the signal contacts. The front shell holds the signal contacts. The rear shell holds the header shields and is electrically connected to each of the header shields.

In another embodiment, a header connector is provided having signal contacts, header shields and a header housing holding the signal contacts and the header shields. The signal contacts are arranged in pairs each having a base, a mating pin extending from a front of the base and a mounting portion extending from a rear of the base for termination to a circuit board. The header shields have walls defining shield pockets receiving corresponding pairs of the signal contacts to provide electrical shielding for the pairs of signal contacts. Each header shield has a base and a mounting portion extending from a rear of the base for termination to the circuit board. The header housing has a front shell and a rear shell. The front shell is dielectric and the rear shell is conductive and providing electrical shielding for the signal contacts. The front shell has a front plate and shroud walls extending from the front plate to define a mating cavity configured to receive a mating electrical connector. The front plate has contact hubs including contact channels arranged in pairs receiving corresponding signal contacts. The front housing has shield channels partially surrounding each contact hub. Each shield channel receives a corresponding header shield. The rear shell includes pockets receiving corresponding header shields and contact hubs. The header shields are electrically connected to the rear shell in the corresponding pocket.

In a further embodiment, an electrical connector system is provided including a printed circuit board having a substrate having a connector surface, signal vias and ground vias with a ground plane electrically connected to the ground vias. The electrical connector system includes a header connector having signal contacts, header shields and a header housing holding the signal contacts and the header shields. The signal contacts are arranged in pairs each having a base, a mating pin extending from a front of the base and a mounting portion extending from a rear of the base received in corresponding signal vias. The header shields have walls defining shield pockets receiving corresponding pairs of the signal contacts to provide electrical shielding for the pairs of signal contacts. Each header shield has a base and a mounting portion extending from a rear of the base received in corresponding ground vias. The header housing has a front shell and a rear shell. The front shell is dielectric and the rear shell is conductive and providing electrical shielding for the signal contacts. The front shell has a front plate and shroud walls extending from the front plate to define a mating cavity configured to receive a mating electrical connector. The front plate has contact hubs including contact channels arranged in pairs receiving corresponding signal contacts. The front housing has shield channels partially surrounding each contact hub. Each shield channel receives a corresponding header shield. The rear shell includes pockets receiving corresponding header shields and contact hubs. The header shields are electrically connected to the rear shell in the corresponding pocket.

DETAILED DESCRIPTION OF THE INVENTION

Figure 1:
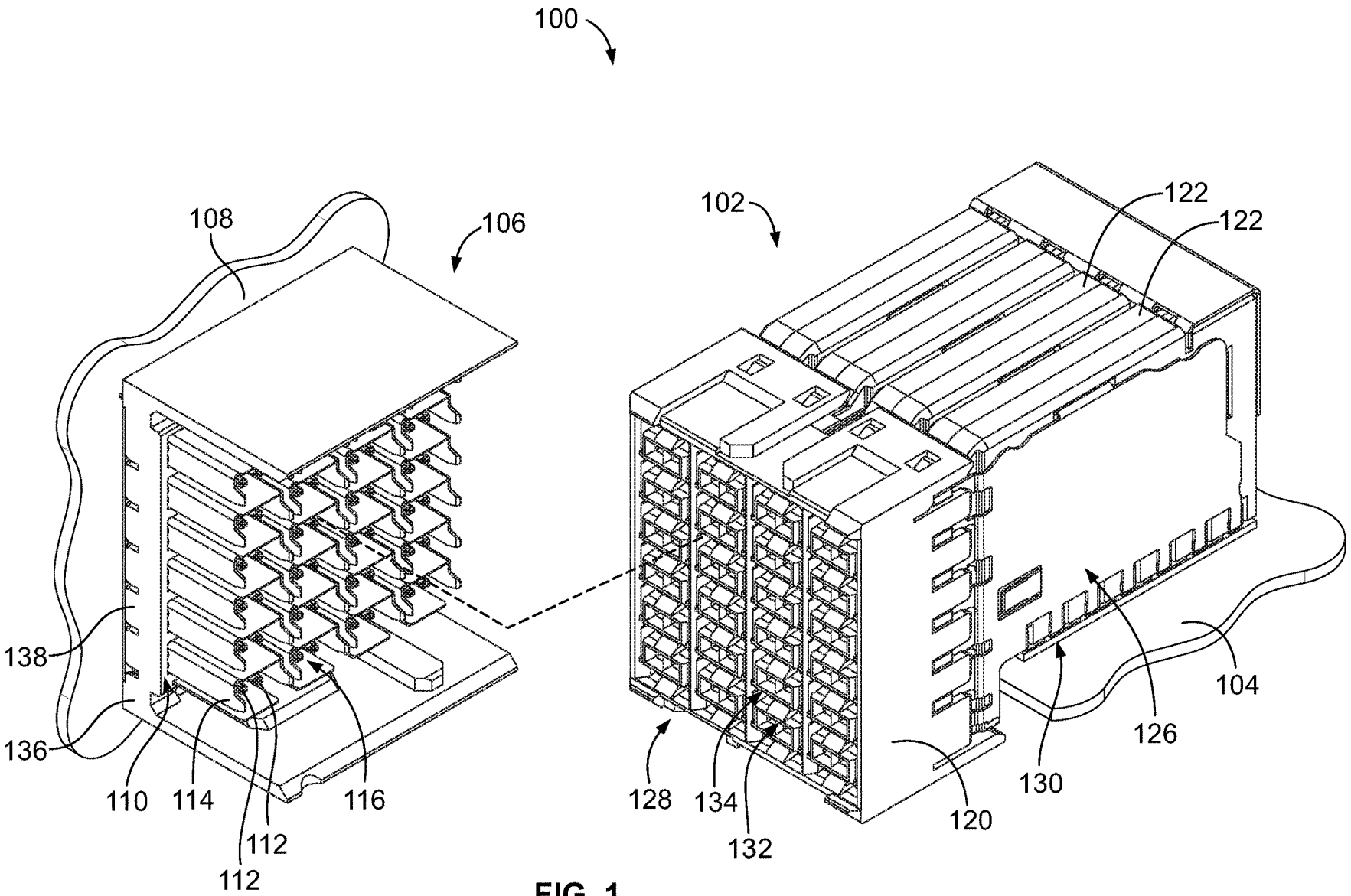
FIG. 1 is a front perspective view of an electrical connector system formed in accordance with an exemplary embodiment.

FIG. 1 is a front perspective view of an electrical connector system 100 formed in accordance with an exemplary embodiment. The connector system 100 includes a first electrical connector 102 configured to be mounted to a printed circuit board (PCB) 104 and a second electrical connector 106 configured to be mounted to a printed circuit board (PCB) 108. In the illustrated embodiment, the electrical connector 106 is a header connector and may be referred to hereinafter as header connector 106. The header connector 106 may be mounted to a backplane circuit board. In the illustrated embodiment, the electrical connector 102 is a receptacle connector and may be mounted to a daughter-card circuit board; however, various other types of connectors may be used in various embodiments. The receptacle connector may be a right angle connector, a vertical connector or another type of connector.

The header connector 106 includes a housing 110 holding a plurality of signal contacts 112 and header shields 114. In an exemplary embodiment, the housing 110 is a multi-piece housing having a dielectric portion at the front that holds the signal contacts 112 and a conductive portion at the rear that is electrically connected to the header shields 114. The conductive portion may be electrically connected to the PCB 108, such as a ground plane at the surface of the PCB 108. The signal contacts 112 may be arranged in pairs 116. Optionally, the signal contacts 112 may be arranged in pairs carrying differential signals; however other signal arrangements are possible in alternative embodiments, such as single-ended applications. Optionally, the pairs 116 of signal contacts 112 may be arranged in columns (pair-in-column signal contacts). Alternatively, the pairs 116 of signal contacts 112 may be arranged in rows (pair-in-row signal contacts).

Each header shield 114 extends around corresponding signal contacts 112, such as around corresponding pairs 116 of signal contacts 112. The header shields 114 provide shielding for each pair 116 of signal contacts 112 along substantially the entire lengths of the signal contacts 112. The header shields 114 may be electrically grounded at the circuit board 108. The header shields 114 may be electrically grounded at the electrical connector 102. In the illustrated embodiment, the header shields 114 are C-shaped having three walls extending along three sides of each pair of signal contacts 112. The header shield 114 adjacent to the pair 116 provides electrical shielding along the fourth, open side of the pair 116. As such, the pairs 116 of signal contacts 112 are circumferentially surrounded on all four sides by the header shields 114.

The electrical connector 102 includes a housing 120 that holds a plurality of contact modules 122. The contact modules 122 are held in a stacked configuration generally parallel to one another. The contact modules 122 may be loaded into the housing 120 side-by-side in the stacked configuration as a unit or group. Any number of contact modules 122 may be provided in the electrical connector 102. The contact modules 122 each include a plurality of signal contacts (not shown) that define signal paths through the electrical connector 102. The signal contacts are configured to be electrically connected to corresponding signal contacts 112 of the header connector 106.

The electrical connector 102 includes a mating end 128, such as at a front of the electrical connector 102, and a mounting end 130, such as at a bottom of the electrical connector 102. In the illustrated embodiment, the mounting end 130 is oriented substantially perpendicular to the mating end 128. The mating and mounting ends 128, 130 may be at different locations other than the front and bottom in alternative embodiments. The signal contacts extend through the electrical connector 102 from the mating end 128 to the mounting end 130 for mounting to the PCB 104.

In an exemplary embodiment, each contact module 122 has a shield structure 126 for providing electrical shielding for the signal contacts. The shield structure is configured to be electrically connected to the header shields 114 of the header connector 106. The shields structure may be ground shields coupled to sides of the contact modules 122. The shield structure 126 may provide shielding from electromagnetic interference (EMI) and/or radio frequency interference (RFI), and may provide shielding from other types of interference as well to better control electrical characteristics, such as impedance, cross-talk, and the like, of the signal contacts. The contact modules 122 provide shielding for each pair of signal contacts along substantially the entire length of the signal contacts between the mating end 128 and the mounting end 130. In an exemplary embodiment, the shield structure 126 is configured to be electrically connected to the mating electrical connector and/or the PCB 104. The shield structure 126 may be electrically connected to the PCB 104 by features, such as grounding pins and/or surface tabs.

The housing 120 includes a plurality of signal contact openings 132 and a plurality of ground contact openings 134 at the mating end 128. The signal contacts are received in corresponding signal contact openings 132. The signal contact openings 132 receive corresponding signal contacts 112 of the header connector 106. In the illustrated embodiment, the ground contact openings 134 are C-shaped extending along three sides of the corresponding pair of signal contact openings 132. The ground contact openings 134 receive header shields 114 of the header connector 106. The ground contact openings 134 also receive portions of the shield structure 126 (for example, beams and/or fingers) of the contact modules 122 that mate with the mating header shields 114 to electrically common the shield structure 126 with the mating header connector 106.

Figure 2:
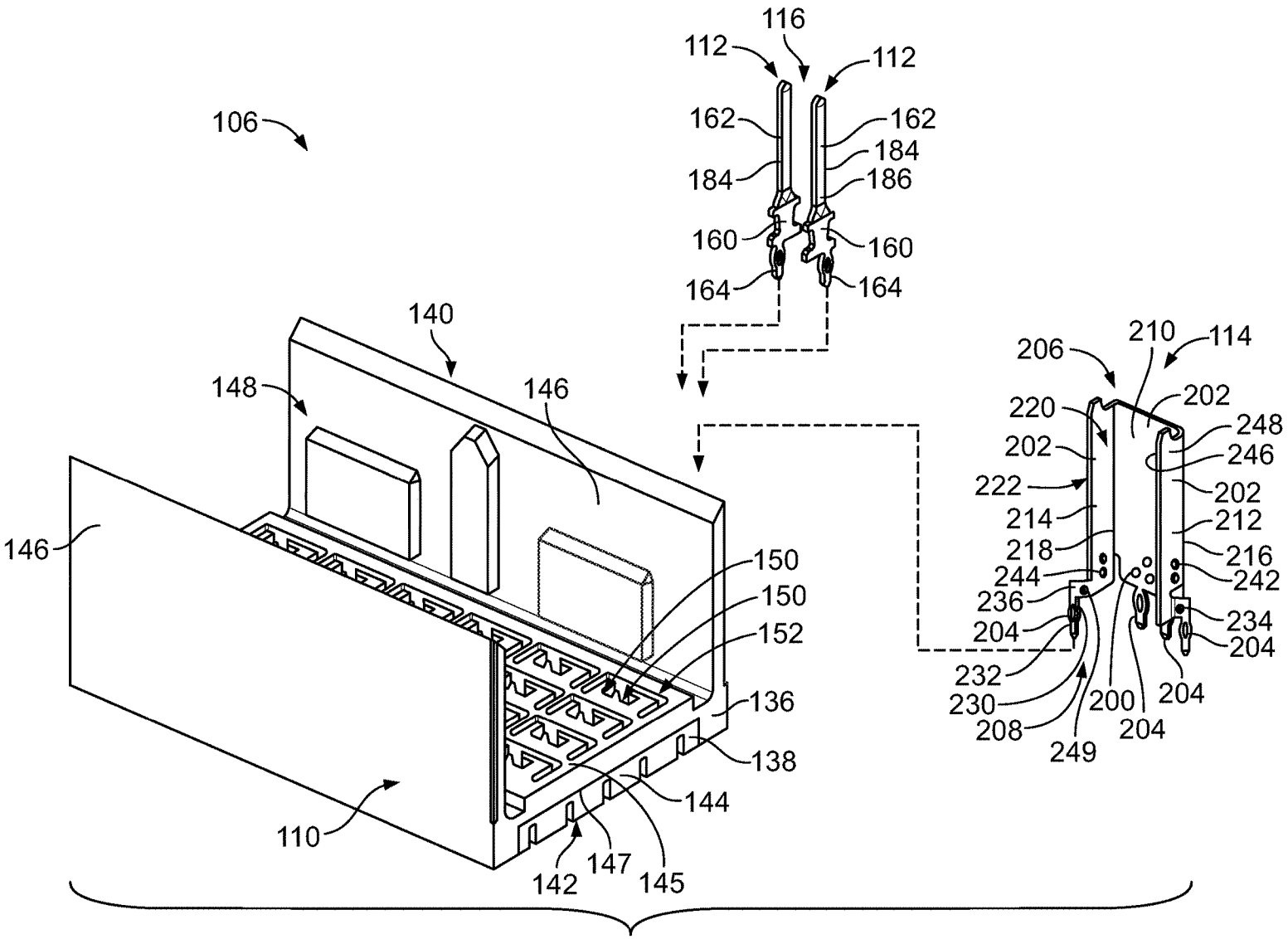
FIG. 2 is an exploded view of a header connector of the electrical connector system in accordance with an exemplary embodiment.
Figure 3:
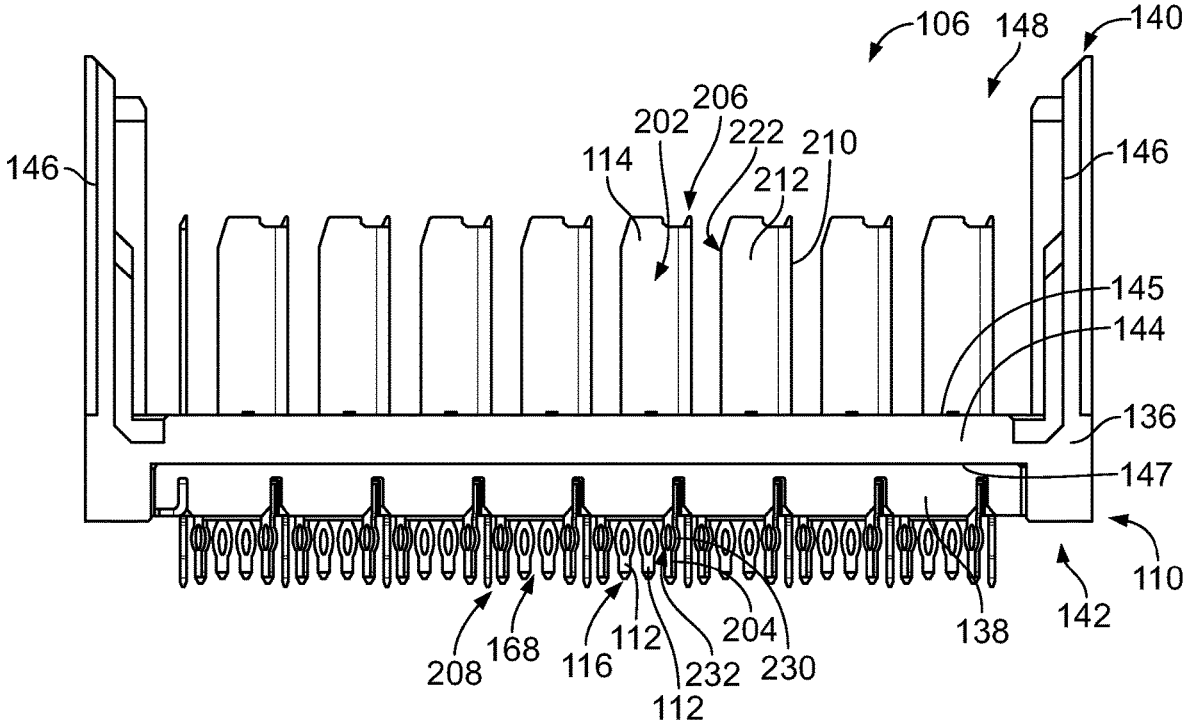
FIG. 3 is a side view of the header connector in accordance with an exemplary embodiment.

FIG. 2 is an exploded view of the header connector 106 in accordance with an exemplary embodiment. FIG. 3 is a side view of the header connector 106 in accordance with an exemplary embodiment. The header connector 106 includes the housing 110 holding the signal contacts 112 and the header shields 114. In an exemplary embodiment, the housing 110 includes a front shell 136 and a rear shell 138. The front shell 136 is manufactured from a dielectric material. The rear shell 138 is manufactured from a conductive material. For example, the rear shell 138 may be plated or coated, such as a plated plastic shell. The rear shell 138 may be molded with conductive particles and nonconductive particles, such as a binder material. The rear shell 138 may be die cast from a metal material. The rear shell 138 provides electrical shielding through at least part of the housing 110. The rear shell 138 electrically commons the header shields 114. The rear shell 138 provides electrical shielding in the mounting zone where the signal contacts 112 and the header shields 114 are mounted to the PCB 108 (shown in FIG. 1).

The housing 110 extends between a mating end 140 and a mounting end 142 configured to be mounted to the PCB 108 (shown in FIG. 1). The front shell 136 is provided at the mating end 140 and the rear shell 138 is provided at the mounting end 142. The front shell 136 includes a front plate 144 at the rear of the front shell 136 and shroud walls 146 extending from the front plate 144 to the mating end 140. The front plate 144 extends between a front surface 145 and a rear surface 147. The front plate 144 has a thickness between the front surface 145 and the rear surface 147. In an exemplary embodiment, the thickness of the front plate 144 is less than the thickness of the rear shell 138. For example, the rear shell 138 has significant thickness to provide rigid structural support for the header shields 114 and/or to provide electrical shielding along a significant depth of the housing 110. The front plate 144 and the shroud walls 146 define a mating cavity 148 configured to receive the electrical connector 102 (shown in FIG. 1). The front plate 144 includes contact channels 150 that receive corresponding signal contacts 112 and shield channels 152 that receive corresponding header shields 114. The signal contacts 112 and the header shields 114 are configured to extend from the front plate 144 into the cavity 148 for mating with the electrical connector 102. The signal contacts 112 and the header shields 114 are configured to extend from the front plate 144 into the rear shell 138 for termination to the PCB 108.

Figure 4:
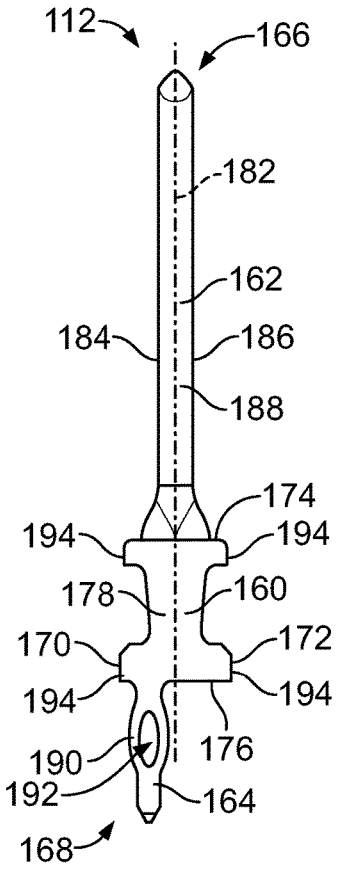
FIG. 4 is a front view of one of the signal contact in accordance with an exemplary embodiment.
Figure 5:
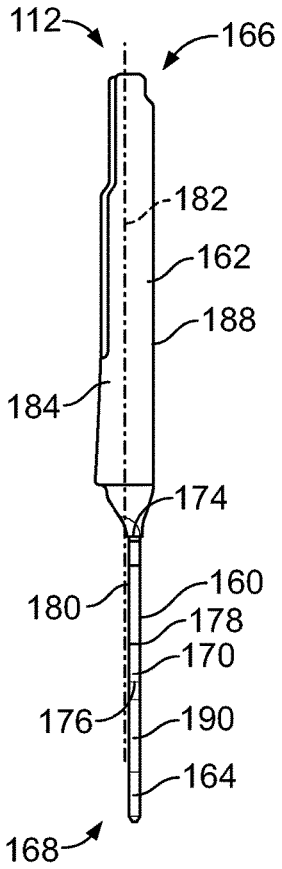
FIG. 5 is a side view of one of the signal contacts in accordance with an exemplary embodiment.

In an exemplary embodiment, the signal contacts 112 are stamped and formed from a metal sheet or blank. Optionally, each of the signal contacts 112 may be identical; however, different signal contacts 112, such as signal contacts within each pair 116 may have different features, such as mirrored features). With additional reference to FIGS. 4 and 5, which are front and side views, respectively, of the signal contacts 112, each signal contact 112 includes a base 160, a mating pin 162 extending from a front of the base 160 and a signal mounting portion 164 extending from a rear of the base 160 opposite the mating pin 162. The base 160 may be held in the contact channel 150 by an interference fit. For example, the base 160 may include dimples, tabs or barbs that interfere with the plastic material of the front shell 136 to hold the signal contact 112 in the front shell 136.

The signal contact 112 extends between a mating end 166 and a mounting end 168. The mating pin 162 is provided at the mating end 166. The signal mounting portion 164 is provided at the mounting end 168 and configured to be terminated to the PCB 108, such as in the signal vias of the PCB 108. The base 160 includes a first edge 170 and a second edge 172 opposite the first edge 170 extending between a top 174 and a bottom 176. The mating pin 162 extends from the top 174 of the base 160. The signal mounting portion 164 extends from the bottom 176 of the base 160. The base 160 has a first side 178 and a second side 180 opposite the first side 178 extending between the top 174 and the bottom 176. In an exemplary embodiment, the signal contacts 112 within each pair 116 are received in corresponding contact channels 150 such that the first sides 178 of the bases 160 face each other and the second sides 180 face away from each other. For example, the signal contacts 112 within each pair 116 are inverted 180° relative to each other. Other orientations are possible in alternative embodiments.

The mating pin 162 extends along a mating pin axis 182. In an exemplary embodiment, the mating pin 162 is oriented relative to the base 160 such that the mating pin axis 182 is approximately centered between the first and second edges 170, 172. In an exemplary embodiment, the mating pin 162 is rolled or formed into a pin shape. For example, edges of the mating pin 162 may be folded inward to form a U-shaped pin. In the illustrated embodiment, the mating pin 162 includes a first rail 184 and a second rail 186 with a folded portion 188 between the first rail 184 and the second rail 186. Optionally, the first and second rails 184, 186 may be separated by a gap. The gap may be open at the second side 180. The folded portion 188 may be provided at the first side 178. Optionally, the first and second rails 184, 186 may extend generally parallel to each other with the folded portion 188 connecting therebetween. The folded portion 188 may be curved between the first and second rails 184, 186. In an exemplary embodiment, the mating pin 162 is offset out of the plane of the base 160, such that the mating pin axis 182 is offset relative to the base 160, such as offset from the second side 180. For example, the base 160 may be directly below the folded portion 188 while the first and second rails 184, 186 are offset relative to the base 160.

The signal mounting portion 164 may be stamped and formed with the base 160. In an exemplary embodiment, the signal mounting portion 164 is a compliant pin, such as an eye of the needle pin. The signal mounting portion 164 includes a compliant portion 190, which may be a bulged portion that is wider than other portions of the signal mounting portion 164. The compliant portion 190 may have an opening 192 therethrough allowing the compliant portion 190 to be flexed or squeezed inward when mating to the PCB 108. In an exemplary embodiment, the signal mounting portion 164 is offset from the mating pin axis 182. For example, the mating pin 162 may be approximately centered between the first and second edges 170, 172, whereas the signal mounting portion 164 is positioned closer to the first edge 170 than the second edge 172. Optionally, the signal mounting portion 164 may be positioned at the first edge 170. When the signal contacts 112 within the pair 116 are coupled to the front shell 136, the signal contacts 112 are inverted 180° relative to each other such that the signal mounting portions 164 are offset in opposite directions from each other, such as on opposite sides of the mating pin axes 182. In an exemplary embodiment, the compliant portion 190 is in plane with the base 160, such as directly below the bottom 176. In alternative embodiments, the signal mounting portion 164 may be offset out of the plane of the base 160.

The signal contact 112 includes barbs 194 along the first and second edges 170, 172 used to secure the signal contact 112 in the front shell 136. For example, the base 160 is received in the contact channel 150 and the barbs 194 dig into the plastic material of the front shell 136 to mechanically hold the signal contact 112 in the front shell 136. Other attachment means may be used in alternative embodiments.

With reference back to FIGS. 2 and 3, the header shield 114 includes a base 200 defined by a plurality of walls 202. The header shield 114 includes ground mounting portions 204 extending from the base 200. The header shield 114 extends between a mating end 206 and a mounting end 208. The base 200 is provided at or near the mounting end 208. The ground mounting portions 204 are provided at the mounting end 208 and configured to be terminated to the PCB 108. For example, the ground mounting portions 204 are configured to be received in the ground vias of the PCB 108. The base 200 is configured to be received in the shield channel 152 in the front plate 144 of the front shell 136. The base 200 is configured to be mechanically and electrically connected to the rear shell 138. The base 200 may be held in the shield channel 152 by an interference fit. The base 200 may be held in the rear shell 138 by an interference fit. For example, the base 200 may include securing features 240, such as dimples, tabs or barbs, which interfere with the plastic material of the front shell 136 and/or the conductive material of the rear shell 138 to mechanically hold the header shield 114 in the front shell 136 and/or the rear shell 138. In the illustrated embodiment, the securing features 240 are dimples and may be referred to hereinafter as dimples 240. In alternative embodiments, the dimples 240 may be provided on the front shell 136 and/or the rear shell 138 to provide the mechanical and/or electrical connection. For example, the dimples may be crush ribs or other types of dimples. Optionally, the header shield 114 may be captured between the front shell 136 and the rear shell 138 and held therebetween.

In an exemplary embodiment, the header shield 114 is C-shaped with the walls 202 including an end wall 210, a first side wall 212 and a second side wall 214. The first side wall 212 extends from a first edge 216 of the end wall 210 and the second side wall 214 extends from a second edge 218 of the end wall 210 opposite the first edge 216. The end wall 210, the first side wall 212 and the second side wall 214 form a shield pocket 220 configured to receive a corresponding pair 116 of the signal contacts 112. The walls 202 surround three sides of the corresponding pair 116 of the signal contacts 112 to provide electrical shielding for the pair 116 of signal contacts 112. The header shield 114 may have other shapes in alternative embodiments. The header shield 114 has an open side 222 opposite the end wall 210 between the first and second side walls 212, 214. The open side 222 is configured to be closed and shielded by the adjacent header shield 114 and/or part of the rear shell 138 to provide circumferential shielding for the shield pocket 220.

The end wall 210 includes one or more of the ground mounting portions 204. The first side wall 212 includes one or more of the ground mounting portions 204. The second side wall 214 includes one or more of the ground mounting portions 204. Each ground mounting portion 204 may be stamped and formed with the base 200. In an exemplary embodiment, the ground mounting portion 204 is a compliant pin, such as an eye of the needle pin. The ground mounting portion 204 includes a compliant portion 230, which may be a bulged portion that is wider than other portions of the ground mounting portion 204. The compliant portion 230 may have an opening 232 therethrough allowing the compliant portion 230 to be flexed and squeezed inward when mating to the PCB 108. In an exemplary embodiment, the end wall 210 includes a pair of the ground mounting portions 204, which are configured to be arranged in line with the signal contacts 112 of the corresponding pair 116.

The end wall 210 includes one or more of the dimples 240. The first side wall 212 includes one or more of the dimples 240. The second side wall 214 includes one or more of the dimples 240. Optionally, the dimples 240 may include front dimples 242 configured to interface with the front shell 136 and rear dimples 244 configured to interface with the rear shell 138. The front dimples 242 and the rear dimples 244 are provided along the base 200. The front dimples 242 are axially offset forward of the rear dimples 244. Optionally, the front dimples 242 may extend from and stand proud of an inner surface 246 of the corresponding walls 210, 212, 214 and the rear dimples 244 may extend from and stand proud of an outer surface 248 of the corresponding walls 210, 212, 214.

In an exemplary embodiment, the first side wall 212 includes a wing 234 configured to be bent out of plane with the first side wall 212. The ground mounting portion 204 extends from the wing 234 and the wing 234 is used to position the ground mounting portion 204 out of the plane of the first side wall 212. Optionally, the wing 234 includes one of the dimples 240 to electrically connect the wing 234 to the rear shell 138. In an exemplary embodiment, the second side wall 214 includes a wing 236 configured to be bent out of plane with the second side wall 214. The ground mounting portion 204 extends from the wing 236 and the wing 236 is used to position the ground mounting portion 204 out of the plane of the second side wall 214. Optionally, the wing 236 includes one of the dimples 240 to electrically connect the wing 236 to the rear shell 138. Optionally, the wings 234, 236 are shaped differently to offset the ground mounting portions 204 relative to each other. For example, the wing 236 may position the corresponding ground mounting portion 204 further from the end wall 210 and the wing 234 may position the corresponding ground mounting portion 204 closer to the end wall 210.

Figure 6:
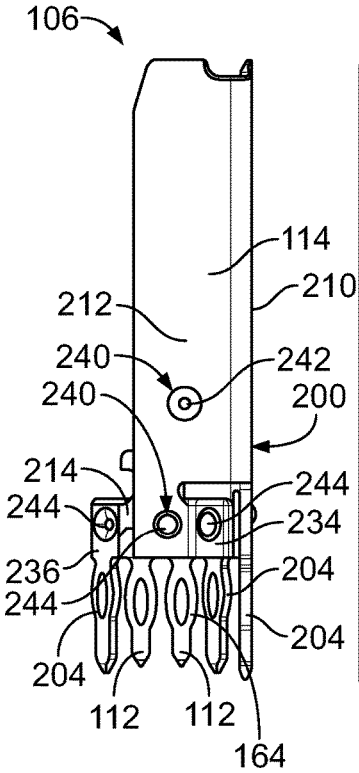
FIG. 6 is a side view of a portion of the header connector showing a header shield and signal contacts.
Figure 7:
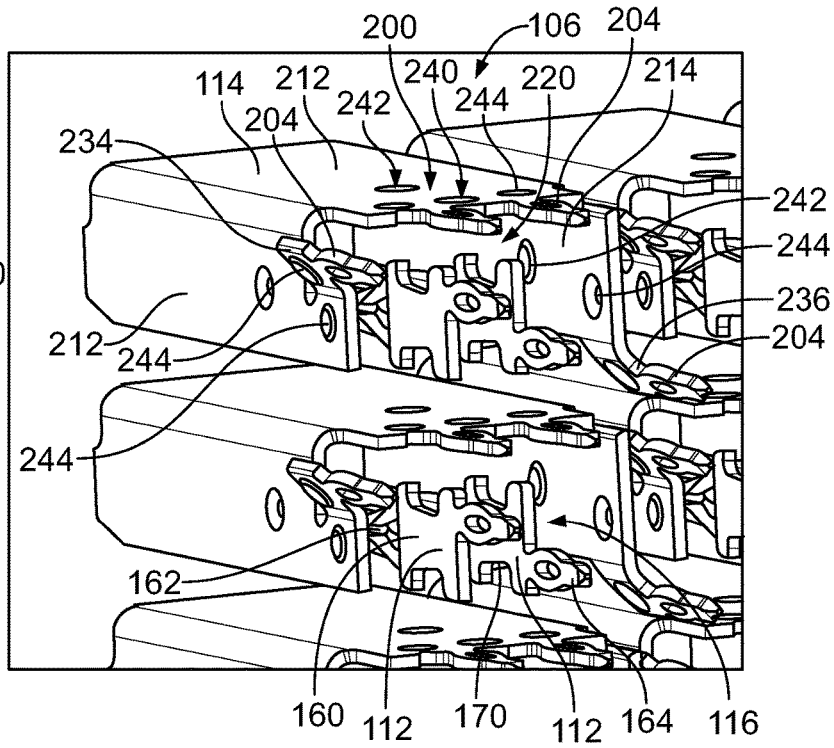
FIG. 7 is a rear perspective view of a portion of the header connector showing signal contacts and header shields.

FIG. 6 is a side view of a portion of the header connector 106 showing one of the header shields 114 and the corresponding signal contacts 112. FIG. 7 is a rear perspective view of a portion of the header connector 106 showing pairs 116 of signal contacts 112 and the corresponding header shields 114. The signal contacts 112 are arranged in the shield pocket 220 and surrounded by the end wall 210, the first side wall 212 and the second side wall 214. The signal contacts 112 are shown inverted relative to each other with the mating pins 162 facing in opposite directions. In the illustrated embodiment, the signal mounting portions 164 are provided at the first edges 170 of the corresponding bases 160. Because the signal contacts 112 are inverted 180° with respect to each other, the signal mounting portions 164 are offset on opposite sides of the corresponding mating pins 162.

The header shield 114 surrounds the signal contacts 112. The ground mounting portions 204 extend from the base 200 for termination to the PCB 108. In the illustrated embodiment, the end walls 210 includes two ground mounting portions 204 that are generally aligned with the bases 160 of the pair 116 of signal contacts 112. The wing 234 includes one of the ground mounting portions 204 and the wing 236 includes one of the ground mounting portions 204. Optionally, other portions of the sidewalls 212, 214 may include ground mounting portions 204.

In an exemplary embodiment, the end wall 210 includes one of the front dimples 242, the first side wall 212 includes one of the front dimples 242, and the second side wall 214 includes one of the front dimples 242. In an exemplary embodiment, the end wall 210 includes multiple rear dimples 244, the first side wall 212 includes one the rear dimples 244, the wing 234 includes one of the rear dimples 244, the second side wall 214 includes one of the rear dimples 244, and the wing 236 includes one of the rear dimples 244. Other arrangements of the dimples 240 are possible in alternative embodiments. In alternative embodiments, the dimples or interference features may be provided on the front shell 136 and/or the rear shell 138 rather than the header shields 114.

Figure 8:
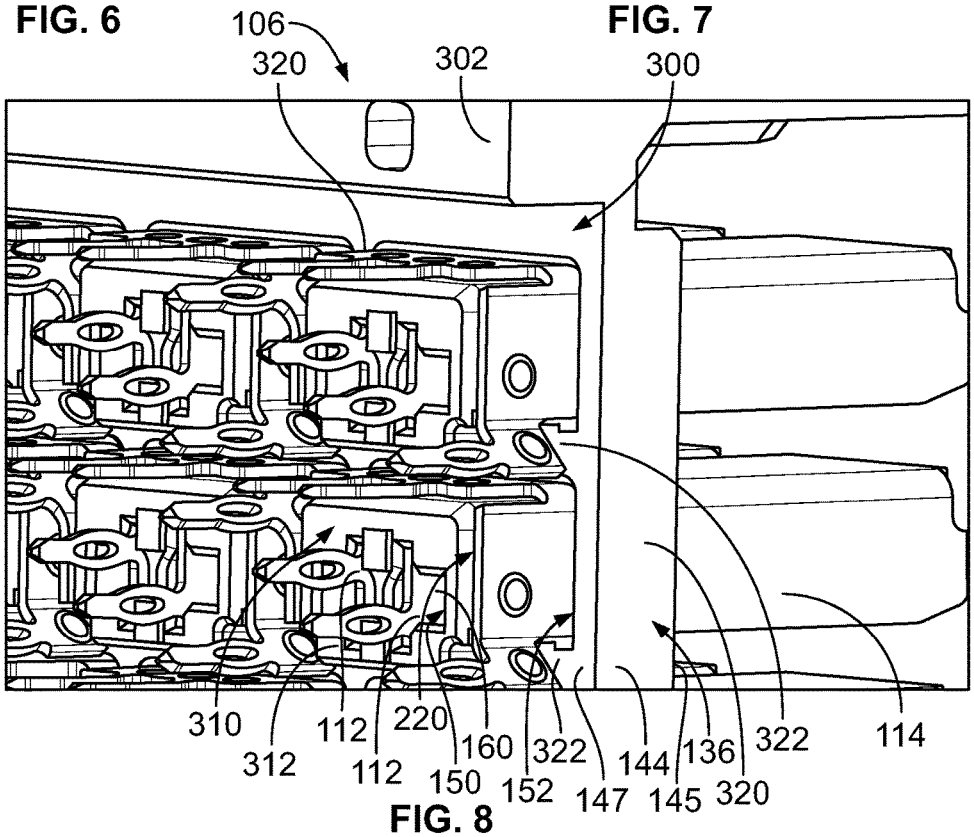
FIG. 8 is a rear perspective view of a portion of the header connector in accordance with an exemplary embodiment with a rear shell removed to illustrate header shields relative to a front shell.

FIG. 8 is a rear perspective view of a portion of the header connector 106 in accordance with an exemplary embodiment with the rear shell 138 removed to illustrate the header shields 114 relative to the front shell 136. In an exemplary embodiment, the front shell 136 includes a chamber 300 at the rear surface 147. The chamber 300 is defined by mounting rails 302 extending rearward from opposite sides of the front shell 136. The mounting rails 302 may be used for mounting the header connector 106 to the PCB 108 (shown in FIG. 1).

In an exemplary embodiment, the front shell 136 includes contact hubs 310 that hold the signal contacts 112. Optionally, each contact hubs 310 has a pair of the contact channels 150 that receive corresponding signal contacts 112. In an exemplary embodiment, the bases 160 of the signal contacts 112 are held in the contact hubs 310. For example, the barbs dig into the dielectric material of the contact hubs 310 to mechanically secure the signal contacts 112 in the contact channels 150. The contact hubs 310 electrically isolate the signal contacts 112 from the header shields 114. In an exemplary embodiment, the contact hubs 310 have hub extensions 312 that extend rearward from the rear surface 147 of the front shell 136. The hub extensions 312 are configured to extend into the rear shell 138. The hub extensions 312 are positioned between the signal contacts 112 and the rear shell 138. The contact channels 150 extend through the hub extensions 312.

In an exemplary embodiment, the front plate 144 of the front shell 136 includes separating walls 320 between columns of contact hubs 310 and cross beams 322 between rows of contact hubs 310. The separating walls 320 and the cross beams 322 are integral with each other and with the contact hubs 310. For example, the separating walls 320, the cross beams 322 and the contact hubs 310 may be co-molded, such as during an injection molding process. In an exemplary embodiment, the separating walls 320 extend longitudinally between the opposite sides of the front shell 136. The cross beams 322 extend laterally between the separating walls 320. The contact hubs 310 are located between adjacent separating walls 320. The contact hubs 310 are located between adjacent cross beams 322. In an exemplary embodiment, the contact hubs 310 extend from corresponding cross beams 322.

The contact hubs 310 are surrounded by the shield channels 152. For example, the shield channels 152 have C-shapes partially surrounding the contact hubs 310. The separating walls 320 are separated from the contact hubs 310 by the shield channels 152. The cross beams 322 are separated from adjacent contact hubs 310 by the shield channels 152. In an exemplary embodiment, the shield channels 152 extend along 3 sides of the contact hubs 310, with the fourth side being connected to the corresponding cross beam 322. The header shields 114 are received in the shield channels 152 and partially surround the contact hubs 310, and the hub extensions 312, through the front shell 136. For example, the contact hubs 310 and the hub extensions 312 are received in the shield pockets 220 of the header shields 114. When the header shields 114 are loaded in the front plate 144, the front dimples 242 (shown in FIG. 6) mechanically engage the front shell 136 to hold the header shields 114 in the front shell 136 by an interference fit. For example, the front dimples 242 may directly engage the contact hubs 310. Alternatively or additionally, the front dimples 242 may directly engage the inner surfaces of the separating walls 320 and/or the cross beams 322. In an exemplary embodiment, the header shields 114 extend forward of the contact hubs 310 and rearward of the contact extensions 312 of the contact hubs 310.

Figure 9:
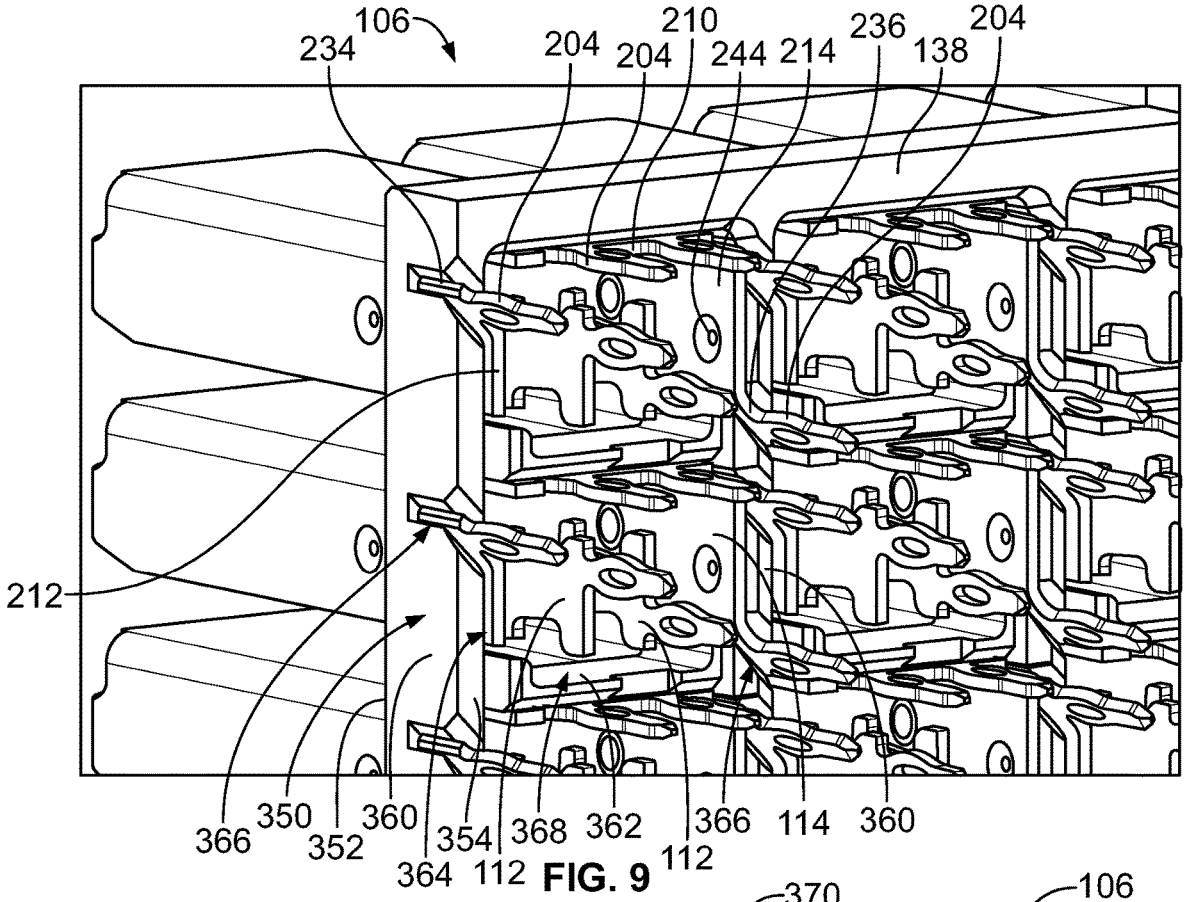
FIG. 9 is a rear perspective view of a portion of the header connector in accordance with an exemplary embodiment with a front shell removed to illustrate the rear shell relative to the header shields and the signal contacts.

FIG. 9 is a rear perspective view of a portion of the header connector 106 in accordance with an exemplary embodiment with the front shell 136 removed to illustrate the rear shell 138 relative to the header shields 114 and the signal contacts 112. In an exemplary embodiment, the rear shell 138 includes a rear plate 350 extending between a front surface 352 and a rear surface 354. The front surface 352 is configured to face and/or abut against the front shell 136 (shown in FIG. 8). The rear surface 354 is configured to face and/or abut against the PCB 108 (shown in FIG. 1).

In an exemplary embodiment, the rear shell 138 includes separating walls 360 and cross beams 362 between the separating walls 360. The separating walls 360 and the cross beams 360 to form pockets 364 that receive corresponding header shields 114 and the signal contacts 112. The pockets 364 are configured to receive the hub extensions 312 (shown in FIG. 8). The separating walls 360 are located between columns of the pockets 364 and the cross beams 362 are located between rows of the pockets 364. The separating walls 360 and the cross beams 362 are integral with each other. For example, the separating walls 360 and the cross beams 362 may be co-molded or cast. The separating walls 360 and the cross beams 362 may be plated or coated such that the separating walls 360 and the cross beams 362 are conductive. In an exemplary embodiment, the separating walls 360 extend longitudinally between the opposite sides of the rear shell 138. The cross beams 362 extend laterally between the separating walls 360 and may be oriented perpendicular to the separating walls 360 defining generally rectangular shaped pockets 364. The pockets 364 may have other shapes in alternative embodiments.

In an exemplary embodiment, the separating walls 360 and/or the cross beams 362 include slots 366 that receive corresponding wings 234, 236 of the header shields 114. The slots 366 may be angled relative to the separating walls 360 and/or the cross beams 362. The slots 366 are open at the rear surface 354 for receiving the wings 234, 236. For example, the header shields 114 may be rear loaded into the rear shell 138.

The header shields 114 are received in the pockets 364 and extend partially around the perimeter of the pockets 364. When the header shields 114 are loaded in the rear plate 350, the rear dimples 244 mechanically engage the rear shell 138 to hold the header shields 114 in the rear shell 138 by an interference fit. The engagement of the rear dimples 244 with the rear plate 350 electrically connects the header shields 114 to the rear shell 138. In alternative embodiments, the dimples or interference features may be provided on the rear shell 138 rather than the header shields 114. In an exemplary embodiment, the header shields 114 have multiple points of contacts with the rear plate 350 using multiple rear dimples 244. For example, the rear dimples 244 may be provided along the end wall 210, the first side wall 212 and the second side wall 214. The rear dimples 244 may be provided along the first wing 234 and the second wing 236. In an exemplary embodiment, the rear dimples 244 are located close to the ground mounting portions 204 to create natural paths for the ground energy between the header shields 114 and the rear plate 350. In an exemplary embodiment, the header shields 114 extend forward of the rear plate 350 for mating with the electrical connector 104 and extend rearward of the rear plate 350 for termination to the PCB 108.

In an exemplary embodiment, the cross beams 362 include grooves 368 formed therein. The grooves 368 thin portions of the cross beams 362 in select areas. For example, the grooves 368 may be provided immediately below the signal contacts 112. The grooves 368 separate or distance the cross beams 322 from the signal contacts 112 for signal integrity. For example, the shape and/or location of the grooves 368 may be selected for impedance control, such as to position the conductive material of the cross beams 362 a predetermined distance from the signal contacts 112. The grooves 368 may receive portions of the hub extensions 312 (shown in FIG. 6). The grooves 368 may be formed in the cross beams 362 to provide spacing for the material of the hub extensions 312, such as for impedance control and or manufacturability of the hub extensions 312.

Figure 10:
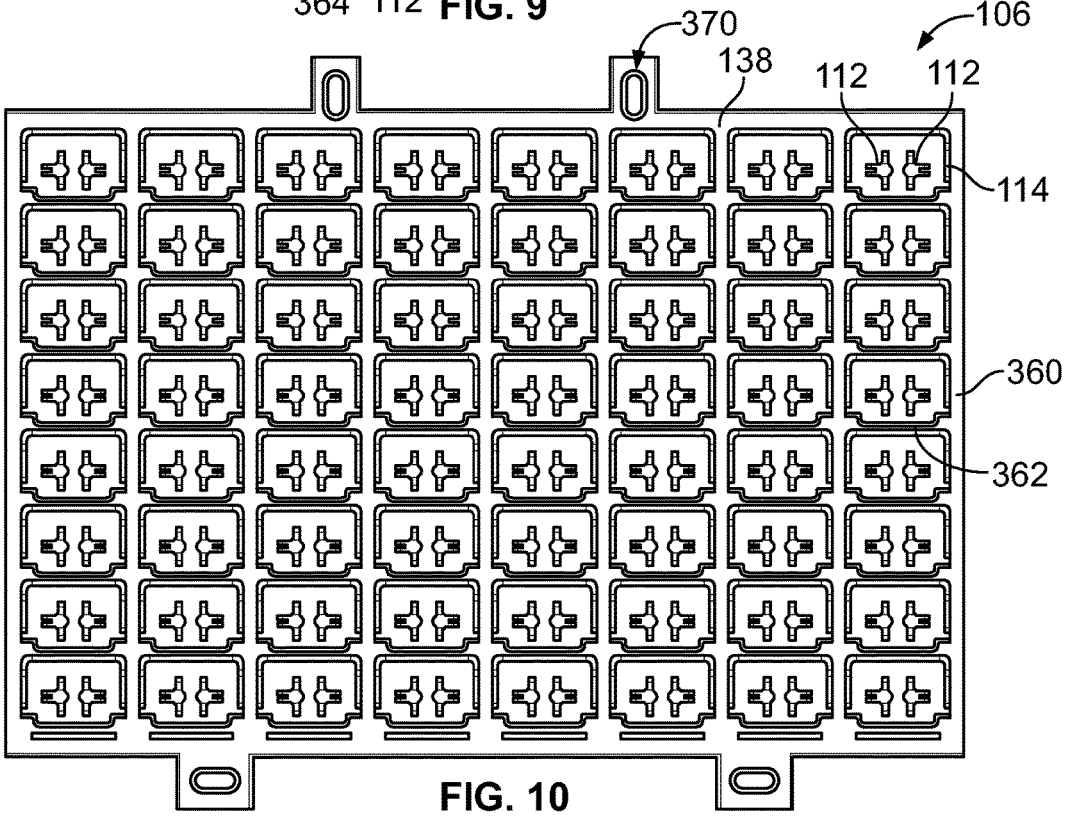
FIG. 10 is a front view of a portion of the header connector in accordance with an exemplary embodiment with the front shell removed to illustrate the rear shell relative to the header shields and the signal contacts.

FIG. 10 is a front view of a portion of the header connector 106 in accordance with an exemplary embodiment with the front shell 136 removed to illustrate the rear shell 138 relative to the header shields 114 and the signal contacts 112. The header shields 114 and corresponding signal contacts 112 are arranged in columns and in rows. The separating walls 360 are arranged between the columns and the cross beams are arranged between the rows.

In an exemplary embodiment, the rear shell 138 includes mounting features 370 for mounting the rear shell 138 to the front shell 136. The mounting features 370, in the illustrated embodiment, are openings configured to receive posts or tabs of the front shell 136. Other types of mounting features may be used in alternative embodiments. In an exemplary embodiment, the mounting features 370 are keyed for keyed mating with the front shell 136. For example, the shape of the mounting features 370 and/or the locations of the mounting features 370 may be used for keyed mating to ensure proper orientation of the rear shell 138 relative to the front shell 136.

Figure 11:
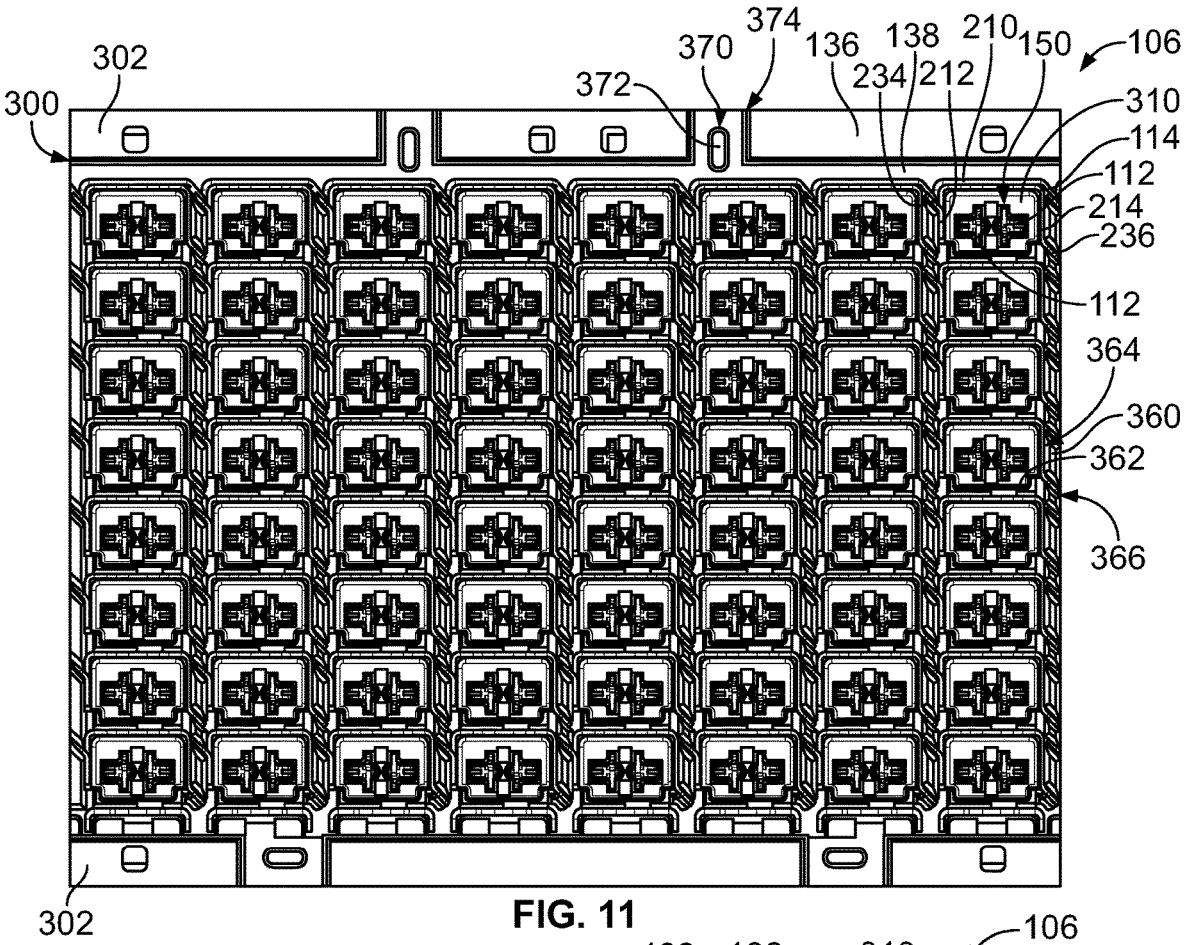
FIG. 11 is a rear view of the header connector in accordance with an exemplary embodiment.
Figure 12:
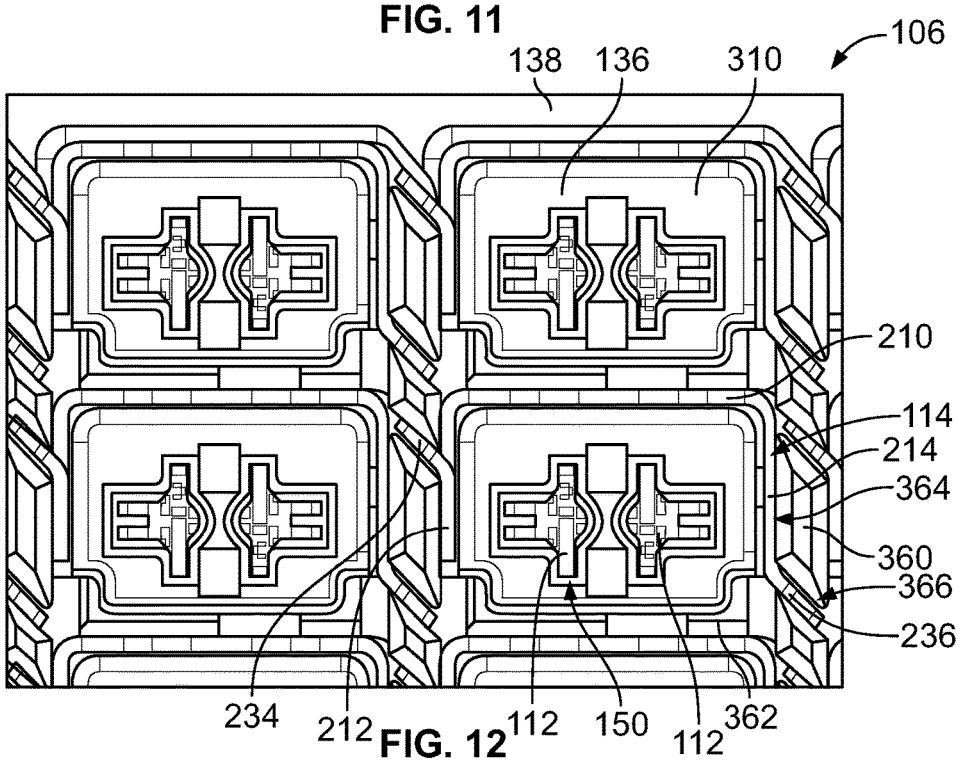
FIG. 12 is an enlarged view of the rear of the header connector in accordance with an exemplary embodiment.

FIG. 11 is a rear view of the header connector 106 in accordance with an exemplary embodiment. FIG. 12 is an enlarged view of the rear of the header connector 106 in accordance with an exemplary embodiment. The rear shell 138 is loaded into the chamber 300 of the front shell 136. The front shell 136 includes mounting features 372 that interact with the mounting features 370 of the rear shell 138. In the illustrated embodiment, the mounting features 372 are posts received in the mounting features 370. In an exemplary embodiment, the mounting rails 302 include pockets 374 that receive the mounting features 370.

When assembled, the signal contacts 112 are received in corresponding contact channels 150 of the contact hubs 310. The contact hubs 310 are received in corresponding pockets 364 in the rear shell 136. The header shields 114 are received in corresponding pockets 364 and the rear shell 136. The header shields 114 surround the contact hubs 310 to provide electrical shielding for the signal contacts 112. In an exemplary embodiment, the header shields 114 are positioned between the contact hubs 310 and the inner surfaces of the separating walls 360 and the cross beams 362 defining the pockets 364. The header shields 114 are pressed into mechanical and electrical contact with the rear shell 136 by the contact hubs 310. For example, the sidewalls 212, 214 engage the separating walls 360 and the end walls 210 engage the cross beams 362. The C-shaped header shields 114 and the cross beams 362 provide circumferential shielding around the signal contacts 112. For example, the cross beams 362 close off the open side of the C-shaped header shields 114. The wings 234, 236 are angled into the corresponding slots 366 and are electrically connected to the rear shell 138 in the slots 366.

In an exemplary embodiment, the rear shell 138 includes a mounting interface 380 for mounting to the printed circuit board 108 (shown in FIG. 1). The mounting interface 380 may be at the rear surface of the rear shell 138. The mounting interface 380 may extend from the rear surface of the rear shell 138. The mounting interface 380 may be a separate component extending from the rear shell 138. The mating interface 380 may be a spring beam or other mating component. The printed circuit board 108 may include a similar or complementary mating interface. The mating interface of the PCB 108 may be a ground pad or a ground plane or a ground via. Optionally, the mounting interface 380 may be soldered to the PCB 108. The mounting interface 380 may be press-fit to the PCB 108. The mounting interface 380 may be a compressing connection, such as a spring beam therebetween.

In an exemplary embodiment, a header connector is provided including signal contacts arranged in pairs, each signal contact having a base, a mating pin extending from a front of the base and a mounting portion extending from a rear of the base for termination to a circuit board; header shields having walls defining shield pockets receiving corresponding pairs of the signal contacts to provide electrical shielding for the pairs of signal contacts, each header shield having a base and a mounting portion extending from a rear of the base for termination to the circuit board; and a header housing holding the signal contacts and the header shields, the header housing having a front shell and a rear shell, the front shell being dielectric, the rear shell being conductive and providing electrical shielding for the signal contacts, the front shell holding the signal contacts, the rear shell holding the header shields and being electrically connected to each of the header shields.

In various embodiments, the front shell includes a front plate having a front surface and a rear surface, the rear shell includes a rear plate having a front surface and a rear surface, the front surface of the rear plate abuts against the rear surface of the front plate. In various embodiments, the front plate has a first thickness and the rear plate has a second thickness greater than the first thickness.

In various embodiments, the front shell includes contact hubs, each contact hub having a pair of contact channels receiving corresponding signal contacts, the contact hub electrically isolating the signal contacts from the header shield. In various embodiments, the contact hubs include hub extensions extending into pockets in the rear shell, the hub extensions being positioned between the signal contacts and the rear shell. In various embodiments, the hub extensions extend beyond a rear surface of the rear shell. In various embodiments, the front shell includes shield channels partially surrounding each contact hub, each shield channel receiving a corresponding header shield, the header shield extending forward of the contact hub and rearward of the contact hub. In various embodiments, the contact hubs include hub extensions extending into pockets in the rear shell, the header shields extending along the hub extensions into the pockets between the rear shell and the hub extensions. In various embodiments, the front shell includes separating walls between columns of hub extensions and cross beams between rows of hub extensions. In various embodiments, the hub extensions extend from corresponding cross beams, the hub extensions being separated from the separating walls by shield channels receiving corresponding header shields.

In various embodiments, the header shield includes dimples at the base, the dimples engaging the rear shell by an interference fit to mechanically and electrically connect the header shield to the rear shell.

In various embodiments, the header shield includes front dimples and rear dimples at the base, the front dimples engaging the front shell by an interference fit to mechanically connect the header shield to the front shell, the rear dimples engaging the rear shell by an interference fit to mechanically and electrically connect the header shield to the rear shell.

In various embodiments, each header shield includes an end wall, a first side wall extending from a first edge of the end wall and a second side wall extending from a second edge of the end wall, the end wall, the first side wall and the second side wall being C-shaped and forming the shield pocket. In various embodiments, the end wall, the first side wall and the second side wall each include dimples engaging the rear shell by an interference fit to mechanically and electrically connect the header shield to the rear shell. In various embodiments, the first side wall includes a wing extending therefrom at an angle, the wing being received in a slot in the rear shell to electrically connect the header shield to the rear shell.

In various embodiments, the rear shell includes a mounting feature, the front shell includes a mounting feature interacting with the mounting feature of the rear shell to secure the front shell to the rear shell. In various embodiments, the mounting feature of the rear shell is keyed for keyed mating with the front shell.

In various embodiments, the rear shell includes separating walls and cross beams between the separating walls forming pockets receiving corresponding header shields and the signal contacts, each header shield engaging and being directly electrically coupled to at least one separating wall and at least one cross beam. In various embodiments, the cross beams include grooves therein to separate the cross beams from the signal contacts for impedance control. In various embodiments, the walls of the header shields are C-shaped having an open side, the cross beams spanning the open side of the corresponding header shield to provide electrical shielding for the corresponding signal contacts.

In various embodiments, the rear shell includes a mounting interface for mounting to the printed circuit board. In various embodiments, the mounting interface is electrically connected to a ground plane of the printed circuit board. In various embodiments, the mounting interface is soldered to the printed circuit board. In various embodiments, the mounting interface is press-fit against an interface of the printed circuit board. In various embodiments, the mounting interface includes a spring beam between the rear shell and a ground conductor of the printed circuit board.

In an exemplary embodiment, a header connector is provided including signal contacts arranged in pairs, each signal contact having a base, a mating pin extending from a front of the base and a mounting portion extending from a rear of the base for termination to a circuit board; header shields having walls defining shield pockets receiving corresponding pairs of the signal contacts to provide electrical shielding for the pairs of signal contacts, each header shield having a base and a mounting portion extending from a rear of the base for termination to the circuit board; and a header housing holding the signal contacts and the header shields, the header housing having a front shell and a rear shell, the front shell being dielectric, the rear shell being conductive and providing electrical shielding for the signal contacts, the front shell having a front plate and shroud walls extending from the front plate to define a mating cavity configured to receive a mating electrical connector, the front plate having contact hubs including contact channels arranged in pairs receiving corresponding signal contacts, the front housing having shield channels partially surrounding each contact hub, each shield channel receiving a corresponding header shield, the rear shell including pockets receiving corresponding header shields and contact hubs, the header shields being electrically connected to the rear shell in the corresponding pocket.

In various embodiments, the front shell includes a front plate having a front surface and a rear surface, the rear shell includes a rear plate having a front surface and a rear surface, the front surface of the rear plate abuts against the rear surface of the front plate. In various embodiments, the front plate has a first thickness and the rear plate has a second thickness greater than the first thickness.

In various embodiments, the contact hubs include hub extensions extending into the pockets in the rear shell, the hub extensions being positioned between the signal contacts and the rear shell. In various embodiments, the hub extensions extend beyond a rear surface of the rear shell.

In various embodiments, the header shield extends forward of the contact hub and rearward of the contact hub.

In various embodiments, the contact hubs include hub extensions extending into the pockets in the rear shell, the header shields extending along the hub extensions into the pockets between the rear shell and the hub extensions.

In various embodiments, the front shell includes separating walls between columns of hub extensions and cross beams between rows of hub extensions.

In various embodiments, the hub extensions extend from corresponding cross beams, the hub extensions being separated from the separating walls by shield channels receiving corresponding header shields.

In various embodiments, the header shield includes dimples at the base, the dimples engaging the rear shell by an interference fit to mechanically and electrically connect the header shield to the rear shell.

In various embodiments, the header shield includes front dimples and rear dimples at the base, the front dimples engaging the front shell by an interference fit to mechanically connect the header shield to the front shell, the rear dimples engaging the rear shell by an interference fit to mechanically and electrically connect the header shield to the rear shell.

In various embodiments, each header shield includes an end wall, a first side wall extending from a first edge of the end wall and a second side wall extending from a second edge of the end wall, the end wall, the first side wall and the second side wall being C-shaped and forming the shield pocket. In various embodiments, the end wall, the first side wall and the second side wall each include dimples engaging the rear shell by an interference fit to mechanically and electrically connect the header shield to the rear shell. In various embodiments, the first side wall includes a wing extending therefrom at an angle, the wing being received in a slot in the rear shell to electrically connect the header shield to the rear shell.

In various embodiments, the rear shell includes a mounting feature, the front shell includes a mounting feature interacting with the mounting feature of the rear shell to secure the front shell to the rear shell. In various embodiments, the mounting feature of the rear shell is keyed for keyed mating with the front shell.

In various embodiments, the rear shell includes separating walls and cross beams between the separating walls forming the pockets, each header shield engaging and being directly electrically coupled to at least one separating wall and at least one cross beam. In various embodiments, the cross beams include grooves therein to separate the cross beams from the signal contacts for impedance control. In various embodiments, the walls of the header shields are C-shaped having an open side, the cross beams spanning the open side of the corresponding header shield to provide electrical shielding for the corresponding signal contacts.

In an exemplary embodiment, an electrical connector system is provided including a printed circuit board (PCB) comprising a substrate having a connector surface, the substrate having signal vias and ground vias, the substrate having a ground plane electrically connected to the ground vias; and a header connector including signal contacts arranged in pairs, each signal contact having a base, a mating pin extending from a front of the base and a mounting portion extending from a rear of the base, the mounting portion being received in a corresponding signal via; header shields having walls defining shield pockets receiving corresponding pairs of the signal contacts to provide electrical shielding for the pairs of signal contacts, each header shield having a base and a mounting portion extending from a rear of the base, the mounting portion being received in a corresponding ground via and being electrically connected to the ground plane of the substrate; and a header housing holding the signal contacts and the header shields, the header housing having a front shell and a rear shell, the front shell being dielectric, the rear shell being conductive and providing electrical shielding for the signal contacts, the front shell having a front plate and shroud walls extending from the front plate to define a mating cavity configured to receive a mating electrical connector, the front plate all having contact hubs including contact channels arranged in pairs receiving corresponding signal contacts, the front housing having shield channels partially surrounding each contact hub, each shield channel receiving a corresponding header shield, the rear shell including pockets receiving corresponding header shields and contact hubs, the header shields being electrically connected to the rear shell in the corresponding pocket.

In various embodiments, the front shell includes a front plate having a front surface and a rear surface, the rear shell includes a rear plate having a front surface and a rear surface, the front surface of the rear plate abuts against the rear surface of the front plate. In various embodiments, the front plate has a first thickness and the rear plate has a second thickness greater than the first thickness.

In various embodiments, the contact hubs include hub extensions extending into the pockets in the rear shell, the hub extensions being positioned between the signal contacts and the rear shell. In various embodiments, the hub extensions extend beyond a rear surface of the rear shell.

In various embodiments, the header shield extends forward of the contact hub and rearward of the contact hub.

In various embodiments, the contact hubs include hub extensions extending into the pockets in the rear shell, the header shields extending along the hub extensions into the pockets between the rear shell and the hub extensions.

In various embodiments, the front shell includes separating walls between columns of hub extensions and cross beams between rows of hub extensions. In various embodiments, the hub extensions extend from corresponding cross beams, the hub extensions being separated from the separating walls by shield channels receiving corresponding header shields.

In various embodiments, the header shield includes dimples at the base, the dimples engaging the rear shell by an interference fit to mechanically and electrically connect the header shield to the rear shell.

In various embodiments, the header shield includes front dimples and rear dimples at the base, the front dimples engaging the front shell by an interference fit to mechanically connect the header shield to the front shell, the rear dimples engaging the rear shell by an interference fit to mechanically and electrically connect the header shield to the rear shell.

In various embodiments, each header shield includes an end wall, a first side wall extending from a first edge of the end wall and a second side wall extending from a second edge of the end wall, the end wall, the first side wall and the second side wall being C-shaped and forming the shield pocket. In various embodiments, the end wall, the first side wall and the second side wall each include dimples engaging the rear shell by an interference fit to mechanically and electrically connect the header shield to the rear shell. In various embodiments, the first side wall includes a wing extending therefrom at an angle, the wing being received in a slot in the rear shell to electrically connect the header shield to the rear shell.

In various embodiments, the rear shell includes a mounting feature, the front shell includes a mounting feature interacting with the mounting feature of the rear shell to secure the front shell to the rear shell. In various embodiments, the mounting feature of the rear shell is keyed for keyed mating with the front shell.

In various embodiments, the rear shell includes separating walls and cross beams between the separating walls forming the pockets, each header shield engaging and being directly electrically coupled to at least one separating wall and at least one cross beam. In various embodiments, the cross beams include grooves therein to separate the cross beams from the signal contacts for impedance control. In various embodiments, the walls of the header shields are C-shaped having an open side, the cross beams spanning the open side of the corresponding header shield to provide electrical shielding for the corresponding signal contacts.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

What is claimed is:

1. A header connector comprising:

signal contacts arranged in pairs, each signal contact having a contact base, a mating pin extending from a front of the contact base and a contact mounting portion extending from a rear of the contact base for termination to a circuit board;

header shields having walls defining shield pockets receiving corresponding pairs of the signal contacts to provide electrical shielding for the pairs of signal contacts, each header shield having a shield base and a shield mounting portion extending from a rear of the shield base for termination to the circuit board; and a header housing holding the signal contacts and the header shields, the header housing having a front shell and a rear shell, the front shell being dielectric, the rear shell being conductive and providing electrical shielding for the signal contacts, the rear shell having pockets, the front shell including contact hubs each having a pair of contact channels receiving corresponding signal contacts, the contact hubs having hub extensions extending into the corresponding pockets to electrically isolate the signal contacts from the rear shell, the front shell holding the signal contacts, the rear shell holding the header shields and being electrically connected to each of the header shields.

2. The header connector of claim 1, wherein the front shell includes a front plate having a front surface and a rear surface, the hub extensions extending rearward of the rear surface of the front plate, the rear shell includes a rear plate having a front surface and a rear surface, the front surface of the rear plate abuts against the rear surface of the front plate with the hub extensions extending into the rear plate.

3. The header connector of claim 2, wherein the front plate has a first thickness and the rear plate has a second thickness greater than the first thickness.

4. The header connector of claim 1, wherein the header shields are received in corresponding pockets, the contact hub electrically isolating the signal contacts from the header shield.

5. The header connector of claim 1, wherein the hub extensions being positioned between the signal contacts and the rear shell.

6. The header connector of claim 5, wherein the hub extensions extend beyond a rear surface of the rear shell.

7. The header connector of claim 1, wherein the front shell includes shield channels partially surrounding each contact hub, each shield channel receiving a corresponding header shield, the header shield extending forward of the contact hub and rearward of the contact hub.

8. The header connector of claim 7, wherein the contact hubs include hub extensions extending into pockets in the rear shell, the header shields extending along the hub extensions into the pockets between the rear shell and the hub extensions.

9. The header connector of claim 1, wherein the front shell includes separating walls between columns of hub extensions and cross beams between rows of hub extensions.

10. The header connector of claim 9, wherein the hub extensions extend from corresponding cross beams, the hub extensions being separated from the separating walls by shield channels receiving corresponding header shields.

11. The header connector of claim 1, wherein the header shield includes dimples at the shield base, the dimples engaging the rear shell by an interference fit to mechanically and electrically connect the header shield to the rear shell.

12. The header connector of claim 1, wherein the header shield includes front dimples and rear dimples at the shield base, the front dimples engaging the front shell by an interference fit to mechanically connect the header shield to the front shell, the rear dimples engaging the rear shell by an interference fit to mechanically and electrically connect the header shield to the rear shell.

13. The header connector of claim 1, wherein each header shield includes an end wall, a first side wall extending from a first edge of the end wall and a second side wall extending from a second edge of the end wall, the end wall, the first side wall and the second side wall being C-shaped and forming the shield pocket.

14. The header connector of claim 13, wherein the end wall, the first side wall and the second side wall each include dimples engaging the rear shell by an interference fit to mechanically and electrically connect the header shield to the rear shell.

15. The header connector of claim 13, wherein the first side wall includes a wing extending therefrom at an angle, the wing being received in a slot in the rear shell to electrically connect the header shield to the rear shell.

16. The header connector of claim 1, wherein the rear shell includes a mounting feature, the front shell includes a mounting feature interacting with the mounting feature of the rear shell to secure the front shell to the rear shell.

17. The header connector of claim 16, wherein the mounting feature of the rear shell is keyed for keyed mating with the front shell.

18. The header connector of claim 1, wherein the rear shell includes a mounting interface for mounting to the printed circuit board.

19. The header connector of claim 18, wherein the mounting interface is electrically connected to a ground plane of the printed circuit board.

20. The header connector of claim 18, wherein the mounting interface is soldered to the printed circuit board.

21. The header connector of claim 18, wherein the mounting interface is press-fit against an interface of the printed circuit board.

22. The header connector of claim 18, wherein the mounting interface includes a spring beam between the rear shell and a ground conductor of the printed circuit board.

23. A header connector comprising:

signal contacts arranged in pairs, each signal contact having a contact base, a mating pin extending from a front of the contact base and a contact mounting portion extending from a rear of the contact base for termination to a circuit board;

header shields having walls defining shield pockets receiving corresponding pairs of the signal contacts to provide electrical shielding for the pairs of signal contacts, each header shield having a shield base and a shield mounting portion extending from a rear of the shield base for termination to the circuit board; and a header housing holding the signal contacts and the header shields, the header housing having a front shell and a rear shell, the front shell being dielectric, the rear shell being conductive and providing electrical shielding for the signal contacts, the front shell holding the signal contacts, the rear shell holding the header shields and being electrically connected to each of the header shields, wherein the rear shell includes separating walls and cross beams between the separating walls forming pockets receiving corresponding header shields and the signal contacts, each header shield engaging and being directly electrically coupled to at least one separating wall and at least one cross beam.

24. The header connector of claim 23, wherein the cross beams include grooves therein to separate the cross beams from the signal contacts for impedance control.

25. The header connector of claim 23, wherein the walls of the header shields are C-shaped having an open side, the cross beams spanning the open side of the corresponding header shield to provide electrical shielding for the corresponding signal contacts.

* * * * *